US008491222B2

(12) United States Patent
Bonnemann

(10) Patent No.: US 8,491,222 B2
(45) Date of Patent: Jul. 23, 2013

(54) VIBRATION TAMPER FOR COMPACTING SUBSOIL

(75) Inventor: Dirk Bonnemann, Neuhaeusel (DE)

(73) Assignee: Bomag GmbH, Boppard (DE)

( * ) Notice: Subject to any disclaimer, the term of this patent is extended or adjusted under 35 U.S.C. 154(b) by 0 days.

(21) Appl. No.: 13/238,438

(22) Filed: Sep. 21, 2011

(65) Prior Publication Data

US 2012/0076583 A1 Mar. 29, 2012

(30) Foreign Application Priority Data

Sep. 23, 2010 (DE) ..... 10 2010 046 401

(51) Int. Cl.
*E01C 19/32* (2006.01)

(52) U.S. Cl.
USPC ..... 404/133.1

(58) Field of Classification Search
USPC ..... 404/133.05, 133.1; 104/14; 173/118
See application file for complete search history.

(56) References Cited

U.S. PATENT DOCUMENTS

| | | | | |
|---|---|---|---|---|
| 3,259,035 | A * | 7/1966 | Pfundt | 404/133.1 |
| 3,270,635 | A * | 9/1966 | Kestel | 404/133.1 |
| 3,416,418 | A * | 12/1968 | Frohnauer, Jr. | 404/133.1 |
| 3,636,834 | A * | 1/1972 | Waschulewski et al. | 404/133.1 |
| 3,847,498 | A * | 11/1974 | Grane et al. | 404/133.1 |
| 3,856,426 | A | 12/1974 | Waschulewski et al. | |
| 4,014,620 | A * | 3/1977 | Vural et al. | 404/133.1 |
| 4,015,909 | A * | 4/1977 | Yamamoto | 404/133.1 |
| 4,186,197 | A * | 1/1980 | Tetsuo | 404/133.1 |
| 5,340,233 | A * | 8/1994 | Motl | 404/133.05 |
| 5,733,071 | A * | 3/1998 | Shudo | 405/271 |
| 6,327,923 | B1 | 12/2001 | Greppmair | |
| 6,601,465 | B2 * | 8/2003 | Greppmair | 74/61 |
| 2003/0185627 | A1 * | 10/2003 | Hausler et al. | 404/133.1 |
| 2004/0234337 | A1 * | 11/2004 | Burkert et al. | 404/133.1 |

FOREIGN PATENT DOCUMENTS

| | | | |
|---|---|---|---|
| DE | 1 954 652 | A1 | 5/1971 |
| DE | 2 236 371 | B1 | 10/1973 |
| DE | 29 48 563 | A1 | 6/1981 |
| DE | 197 14 555 | C2 | 10/1998 |
| GB | 1 262 034 | A | 2/1972 |

OTHER PUBLICATIONS

German Patent and Trademark Office, Search Report, Application No. 10 2010 046 401.5, mailed Jun. 14, 2011, 5 pages.

* cited by examiner

*Primary Examiner* — Thomas B Will
*Assistant Examiner* — Abigail A Risic
(74) *Attorney, Agent, or Firm* — Wood, Herron & Evans, LLP

(57) ABSTRACT

A vibration tamper for compacting subsoil comprises a superstructure and a substructure, with the superstructure comprising a motor and an eccentric disk which is driven by the same. A connecting rod is eccentrically mounted on the eccentric disk, which connecting rod converts the rotational movement into a linear movement. The substructure comprises a tamper foot with a tamper plate which is driven by the linear movement of the connecting rod into a tamper movement along a tamper axis. As a result of the bent portion of the connecting rod, the tamper axis is disposed in a plane which is disposed parallel to a plane opened up by the bearing of the connecting rod on the eccentric disk against a direction opposite of the advancing direction of the vibration tamper.

5 Claims, 5 Drawing Sheets

VIBRATION TAMPER FOR COMPACTING SUBSOIL

CROSS-REFERENCE TO RELATED APPLICATIONS

The present application claims priority under 35 U.S.C. §119 of German Patent Application No. DE 10 2010 046 401.5, filed on Sep. 23, 2010, the disclosure of which is hereby incorporated herein by reference in its entirety.

FIELD OF THE INVENTION

The present invention relates to a vibration tamper for compacting subsoil, comprising a superstructure and a substructure, with the superstructure substantially comprising a housing with a motor, an output shaft, a bearing in the housing for an eccentric disk which is in engagement with the output shaft, and a bearing for a connecting rod which is arranged eccentrically on the eccentric disk and transmits the mechanical work of the motor to the substructure, wherein the substructure substantially comprises a tamper foot housing extending along the tamper axis with a tamper plate.

BACKGROUND OF THE INVENTION

Such vibration tampers are used for compacting subsoil, especially in the construction of ditches, in the construction of canals and pipelines or in backfilling in horticulture and landscaping. In the construction of traffic routes, they are mainly used for repair work and compacting work on shoulders.

As a result of their construction, the vibration tampers have an advancing motion in the working direction. The processed surface is not punctiform by the tamper, but planar and not fixed in respect of location. The arrangement of the advancing motion of the tamper is directly linked to the orientation of the oscillating masses of the tamper and especially the orientation of the oscillating masses relating to the center axis of the exciter apparatus or the tamper axis of the substructure.

In addition to the influence on the formation of the advancing motion, there is also an undesirable vibratory excitation of the control lever by the oscillating masses in orientation to the center axis, which therefore has a negative effect on the operating comfort. As a result, the quantitative alignment of the oscillating masses relative to the center axis has a considerable influence on the motion behavior of the entire machine, the operating comfort and the compacting performance.

In the case of the vibration tampers of the kind mentioned above as known from the state of the art, it is necessary to arrange balancing masses especially in the housing in such a way that the loads especially acting on the bearings for the connecting rods and the eccentric disk are reduced. This considerably increases the total mass of the vibration tamper. Moreover, the center of gravity of the vibration tampers known from the state of the art is negatively arranged towards the rear concerning the advancing motion behavior, which is also improved by means of balancing masses. This also has negative effects on the apparatus as a whole.

SUMMARY OF THE INVENTION

It is therefore the object of the present invention to provide a vibration tamper of the kind mentioned above which, in combination with a reduced overall weight, offers an improved compaction performance and especially a higher operating comfort, with especially the tensions acting on the bearings of the tamper drive being reduced.

This object is achieved by a vibration tamper of the kind mentioned above in such a way that the connecting rod comprises a bent portion which circumvents the eccentric disk against the advancing direction of the vibration tamper, so that the tamper axis is offset in the direction of the motor.

The arrangement of the tamper axis in accordance with the present invention leads to the consequence that the axial movements of the connecting rod, and especially the compaction pulses resulting therefrom which act along the tamper axis on the tamper plate, have a very low influence on the bearing of the eccentric disk and the eccentric disk per se, especially in the form of bending moments.

Especially, the arrangement of the connecting rod bearing in the eccentric disk and the arrangement of the tamper axis or the arrangement of the connecting rod in such a way that the tamper axis extends through this connecting rod bearing in the eccentric disk leads to the consequence that bending tensions in the connecting rod bearing are eliminated nearly completely and the loads in the bearing of the eccentric disk are minimized.

The arrangement of the tamper axis in such a way that it extends between the planes opened up by the connecting rod bearing or the bearings of the eccentric disk leads to the consequence that the bending tensions in the connecting rod bearing are minimized and are reduced to a considerable extent in the bearing points of the eccentric disk. Such an embodiment is especially possible in the case of the arrangement of the connecting rod bearing in the connecting rod, which means in a bearing point arranged in the connecting rod.

In order to achieve the arrangement of the tamper axis according to the conditions as mentioned above in a technically simple and operationally secure manner, the tamper axis is preferably arranged to be offset in the direction of the motor. This is simply achieved in such a way that the connecting rod is arranged in a cranked manner in the direction of the motor. A relevant point is that in the case of such a displaced tamper axis it is possible to omit a large part of the balancing masses. Moreover, the tensions introduced into the various bearings and drive trains will further be reduced.

Preferably, the connecting rod is cranked in the direction of the axis of the output shaft. As a result, it is possible to have a purposeful influence on the balance of the masses arranged in an offset manner relative to the resulting tamper axis.

The connecting rod transmits the mechanical work of the motor preferably by means of a cross-head to the substructure. Decisive freedoms in the arrangement of the geometry of the apparatuses in the superstructure and substructure are obtained thereby.

The eccentric disk is arranged in the tamper axis in one special embodiment. In combination with an arrangement in which the bearing of the connecting rod in the eccentric disk is linked by way of a bearing journal to the connecting rod, a balance of masses is obtained in the vibration tamper which is characterized by very low bending moments.

In order to reduce the oscillating masses to the highest possible extent, the connecting rod is made of metal or light metal or an alloy of the two.

An especially low-vibration embodiment is obtained when the output shaft is oriented perpendicularly to the tamper axis. The tamper axis is especially preferably arranged in this connection in such a way that it intersects the output shaft.

An embodiment provides a configuration of a vibration tamper with the lowest possible oscillations in which the ratio of the masses of superstructure and substructure are balanced with respect to the tamper axis.

BRIEF DESCRIPTION OF THE DRAWINGS

The present invention will be explained below in closer detail by reference to two embodiments shown in the drawings, which show schematically.

The same reference numerals will be used below for the same components or those acting in a similar capacity.

DETAILED DESCRIPTION OF THE INVENTION

Figure 1:
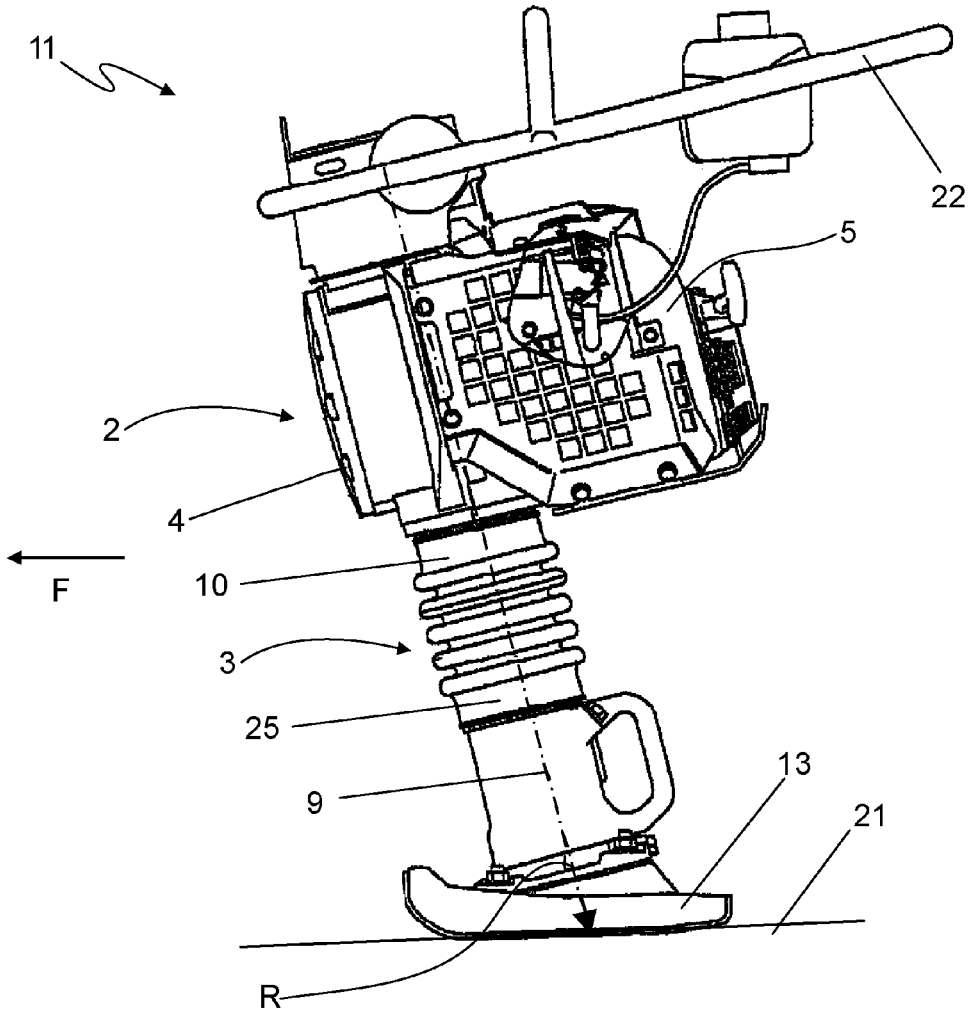
FIG. 1 shows a side view of a first embodiment of a vibration tamper.
Figure 2:
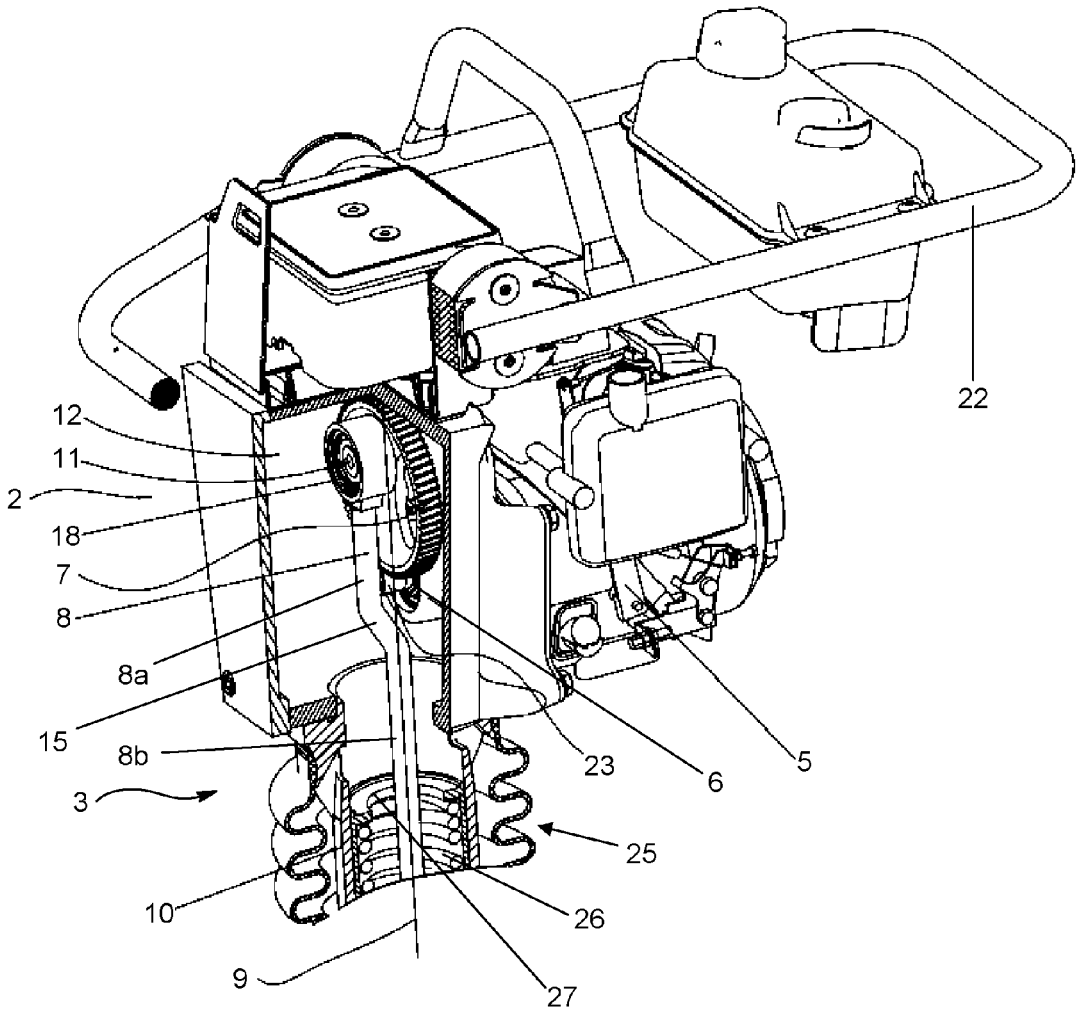
FIG. 2 shows an isometric detailed view of the embodiment of FIG. 1 in a partly sectional state.

FIG. 1 shows a first embodiment of a vibration tamper 1. It comprises a superstructure 2 and an adjacent substructure 3. The superstructure 2 contains a motor 5 and a transmission housing 4 with an exciter apparatus 12 (FIG. 2). The substructure 3 comprises a tamper foot 25 with a tamper foot housing 10, a tamper plate 13, a spring system 26 (FIG. 2), of which a spring is shown partly, and a partly illustrated guide cylinder 27 (FIG. 2) for the spring system 26. The superstructure 2 further comprises a handlebar 22 for an operator. When the tamper plate 13 is made to vibrate, subsoil 21 can be compacted with the vibration tamper 1.

The vibration tamper 1 is arranged in such a way that in the idle state it is forwardly inclined relative to the orthogonal of the subsoil 21. The inclination is provided by a virtual tamper axis 9 which substantially determines the direction of a resultant R of a compaction force emitted to the subsoil and which corresponds to the central axis of the tamper foot housing 10. This configuration of the vibration tamper 1 causes an advancing motion in operation in an advancing direction F in the working direction of the vibration tamper 1. The processed surface is therefore not punctiform and not fixed in relation to location. The components of the vibration tamper 1, and especially the masses driven by the motor 5, are arranged in such a way that the resulting tensions on the respective bearings, drive and transmission elements are reduced in combination with a simultaneous minimization of the total weight of the apparatus.

FIG. 2 shows the transmission housing 4 and the tubular tamper foot housing 10 of the vibration tamper 1 according to FIG. 1 in a partly sectional, isometric illustration. The tamper foot housing 10 is fastened to the transmission housing 4 of the superstructure 2. The exciter apparatus 12 comprises an eccentric disk 7 which is provided with an external gearing and which meshes with a pinion 23 which is arranged on an output shaft 6 of motor 5. The eccentric disk 7 is used for driving a connecting rod 8 which transmits the rotating movement provided by the motor 5 as an oscillating movement to the spring system 26 and the guide cylinder 27 for the spring system 26 which is operatively connected with the tamper plate 13. The guide cylinder 27 is held in a longitudinally displaceable manner in the tamper foot housing 10 and carries the tamper plate 13 at its end.

The connecting rod 8 is provided with a bent portion 15 which circumvents the eccentric disk 7 and the pinion 23 and extends against the advancing direction F. A second section **8*b* which is associated with the tamper plate 13 is thereby offset to the rear with respect to a first eccentric section 8*a* against the advancing direction F in the direction towards the motor 5. In the illustrated example, the bent portion 15 lies within the transmission housing 4 and the section 8*a* on the side of the eccentric is as short as possible and only so long that the bent portion 15 does not obstruct a movement of the connecting rod 8 during a rotation of the eccentric disk 7**.

Motor 5 is in operative engagement with the eccentric disk 7 by way of the output shaft 6 and the pinion 23, so that the rotation of the shaft is transmitted via the output shaft 6 to the eccentric disk 7. A crankpin 11 for the connecting rod 8 is arranged on the eccentric disk 7 in an eccentric manner in relation to the eccentric disk 7, which engages in a connecting rod bearing 18 or a bearing eye in the connecting rod 8. The other free end of the connecting rod 8 is mounted in the known articulated manner within the guide cylinder 27 on a guide piston (not shown) which is operatively connected with the spring system 26. The free end of the connecting rod 8 performs an oscillating linear movement along the tamper axis 9 during a rotation of the eccentric disk 7. This axial movement is transmitted via the spring system 26 and the guide cylinder 27 onto the tamper plate 13, so that the tamper plate 13 performs a tamping motion along the tamper axis 9.

Figure 3:
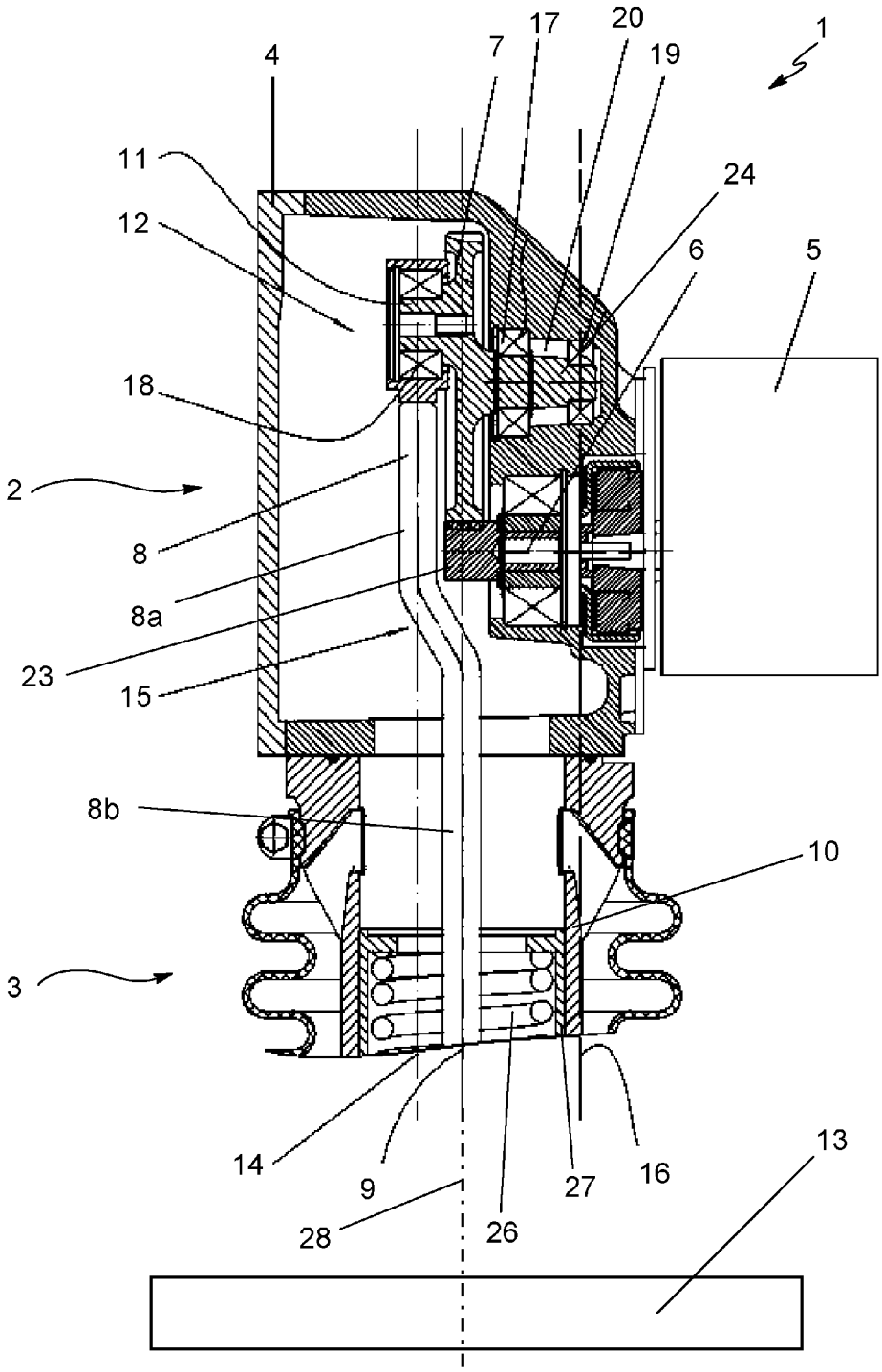
FIG. 3 shows a lateral sectional view of the detailed illustration of FIG. 2, FIG. 4 partly shows a second embodiment of a vibration tamper in a mode of illustration according to FIG. 3, and FIG. 5 partly shows a third embodiment of a vibration tamper in a mode of illustration according to FIG. 3.

FIG. 3 shows a longitudinal sectional view of the isometric partial illustration of the vibration tamper 1 as shown in FIG. 2. The most relevant components of the superstructure 2, an upper section of the substructure 3 and the tamper plate 13 are shown.

The eccentric disk 7 comprises a centric bearing journal 24 on the motor side, which bearing journal is mounted parallel to the output shaft 6 of motor 5 in a wall of the transmission housing 4 on the motor side. Two mutually spaced eccentric bearings 17, 19 are provided for this purpose in the transmission housing 4. The first eccentric bearing 17 is disposed in the region of the base point of the bearing journal 24 and the second eccentric bearing 19 is disposed in the region of the free end of the bearing journal 24 close to motor 5. This rotational bearing in the transmission housing 4 ensures a reliable discharge of forces between the transmission housing 4 and the eccentric disk 7.

The connecting rod bearing 18 of the connecting rod 8 acts on the eccentric disk 7 by way of the eccentric crankpin 11 arranged on the eccentric disk 7 in such a way that the rotational movement of the eccentric disk 7 is converted into a linear movement of the free end of the connecting rod 8 along the tamper axis 9.

The advancing motion of the vibration tamper 1 is in direct connection with the arrangement of the mass of the superstructure 2 on the one hand, especially the oscillating mass of the exciter apparatus 12, relating to the tamper axis 9 and the mass of the substructure 3 on the other hand, especially the oscillating mass of the tamper plate 13, the spring system 26 and the guide cylinder 27 in the tamper foot housing 10. Moreover, the undesirable oscillating excitation of the handlebar 22 is influenced by the oscillating masses. The quantitative alignment of the oscillating masses relating to the tamper axis 9 thus has a strong influence on the movement behavior of the entire vibration tamper 1, on the compaction performance and the operating comfort.

The connecting rod bearing 18 and the first section **8*a* of the connecting rod 8 on the eccentric side come to lie in a vertical first plane 14 which is disposed perpendicularly to the output shaft 6 and to the bearing journal 24. The first plane 14 lies with respect to the advancing direction F before a parallel vertical second plane 28 which is opened up by the eccentric disk 7 and before a parallel third plane 16 which is opened up by the second eccentric bearing 19. The second section 8***b* of the connecting rod 8 can principally be disposed in the second or third plane 28, 16 or a parallel plane disposed between these two planes. The plane in which the second section 8*b* of the connecting rod 8 is disposed determines the position of the oscillating masses of the substructure 3, with which the free end of the connecting rod 8 is operatively connected, and thereby the position of the tamper axis 9.

Since the oscillating mass of the substructure 3 is arranged to be offset to the rear by the bent portion 15 in relation to the oscillating mass of the superstructure 2 against the advancing direction, the bent portion 15 improves the orientation of the oscillating masses of the superstructure 2 and the substructure 3 relative to the tamper axis 9 and improves the advancing behavior, the compacting performance and the hand-arm vibration of the operator in such a way that the oscillating mass of the substructure is offset to the rear against the advancing direction of the vibration tamper.

In the illustrated example, the second section 8*b* of the connecting rod 8 is arranged in the second plane. The tamper axis 9 accordingly lies in the illustrated example in the second plane 28.

As a result, the eccentric disk 7 lies in the illustrated example on the tamper axis 9, which keeps the bending tension at a comparatively low level in the region of the eccentric bolt 11 and the connecting rod bearing 18.

If the bent portion 15 is enlarged, the oscillating mass of the substructure 3 can be arranged in an offset manner further to the back. The advancing behavior, the compacting performance and the operating comfort can be optimized in this manner. No further additional balancing masses are required, or only very few ones, in order to ensure low-vibration operation of the vibration tamper. Moreover, the bending forces acting on the eccentric bearings 17, 19 of the eccentric disk 7 can be minimized when the eccentric bearings 17, 19 come to lie on the tamper axis 9 or opposite of one another with respect to the tamper axis 9.

Figure 4:
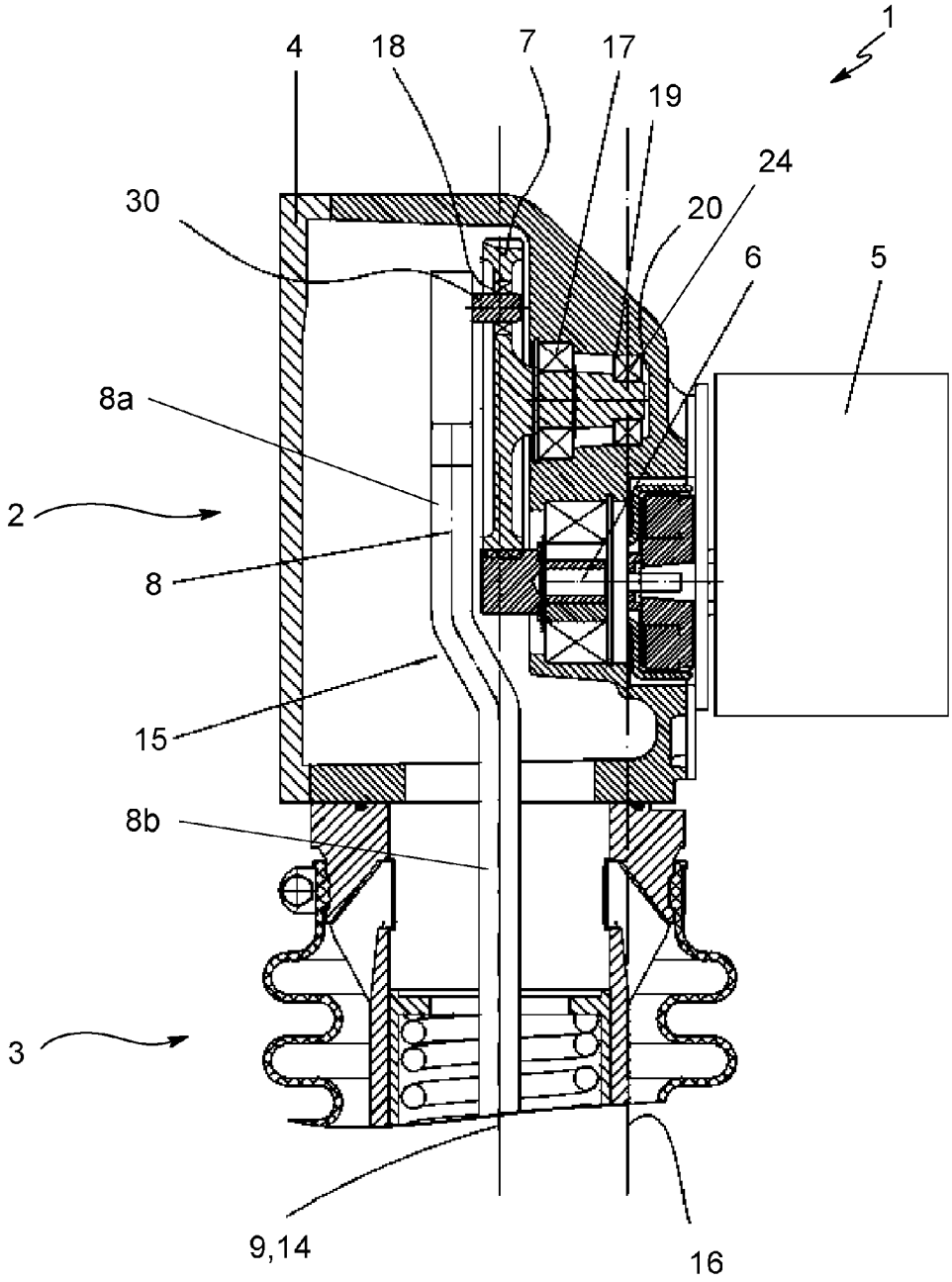
Figure 5:
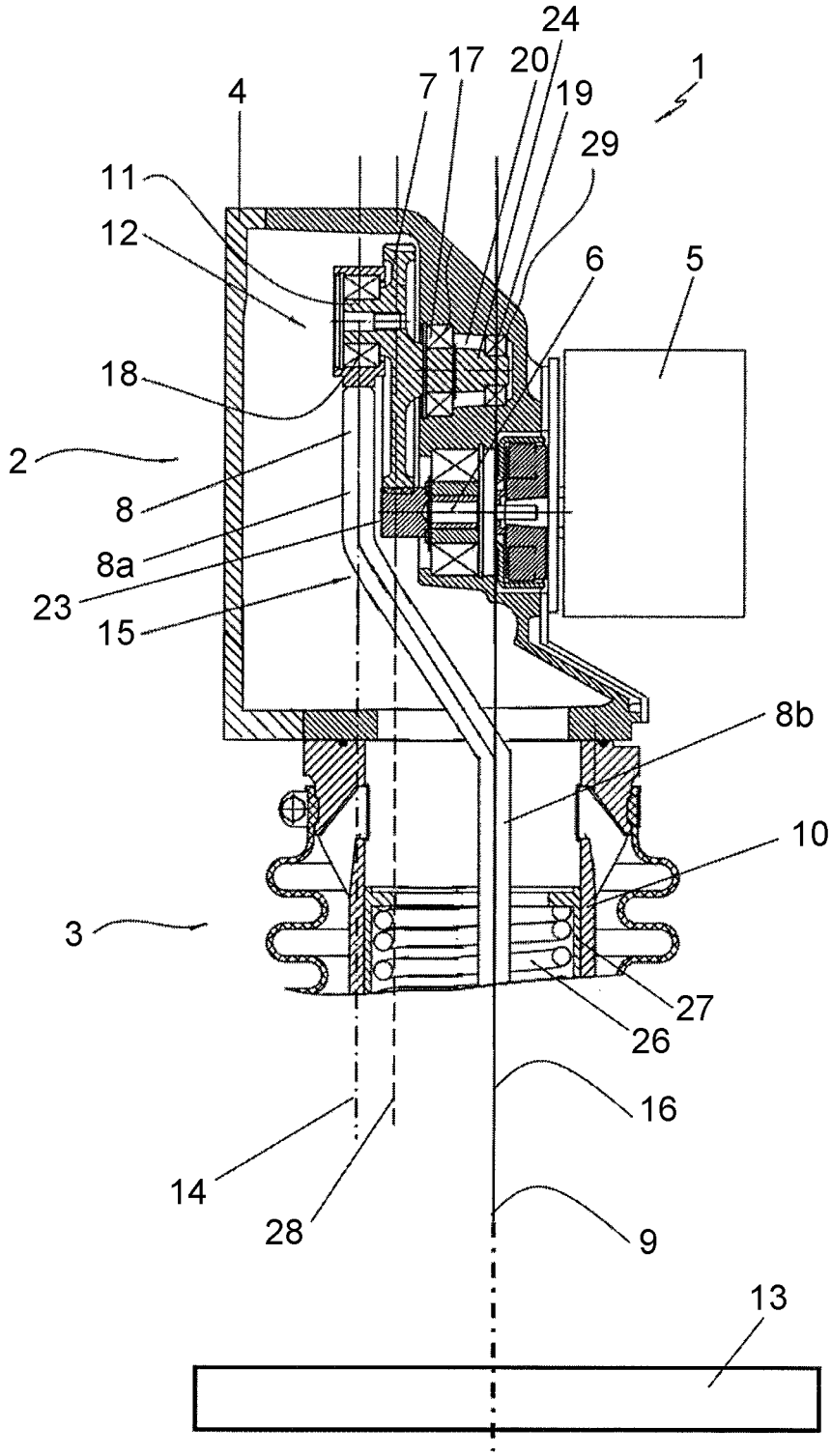

FIG. 4 shows a second embodiment of the vibration tamper 1 in an embodiment according to FIG. 3. The superstructure 2 and the substructure 3 are shown in this case too. A rotational movement is converted by way of an eccentric drive, which is formed in this case by the eccentric disk 7 and the connecting rod 8, into an axial movement along the tamper axis 9 by way of motor 5 and the output shaft 6.

In accordance with one embodiment of the present invention as shown in FIG. 4, the connecting rod bearing 18 is directly arranged in the eccentric disk 7 for the pivotal eccentric connection of the connecting rod 8 to the eccentric disk 7. In contrast to the first embodiment according to FIG. 3, the eccentric disk 7 comprises the connecting rod bearing 18 in the eccentric disk 7. As a result, the tamper axis 9 extends through the connecting rod bearing 18, or it is disposed in the plane 14 which is opened up by the connecting rod bearing 18. The connecting rod 8 is provided with a journal 30 which engages in the connecting rod bearing 18. As in the first embodiment, the eccentric disk 7 is mounted by way of the eccentric bearings 17, 19 which are arranged in a respectively arranged bearing groove 20 on the housing 4 of superstructure 2.

In this embodiment, the bending tensions which act on the connecting rod bearing 18 are eliminated to a substantially complete extent by the masses arranged on both sides of the tamper axis 9, with the bending loads acting on the bearing points of the eccentric disk 7 nevertheless also being minimized by the arrangement of the bent connecting rod 8.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A vibration tamper for compacting subsoil during movement of the vibration tamper in an advancing direction F, comprising:

a superstructure and a substructure, with the superstructure comprising:

a motor;

an eccentric disk; and at least one bearing for the eccentric disk, with a connecting rod being arranged in an eccentric manner on the eccentric disk by way of a connecting rod bearing; and the substructure comprising:

a tamper plate which is operatively connected with the free end of the connecting rod and which is thereby driven to a linear tamper movement along a tamper axis, wherein the connecting rod comprises:

a first section disposed in a first plane, a second section disposed in one of (i) a second plane parallel to the first plane and intersecting the eccentric disk, (ii) a third plane parallel to the second plane and intersecting the at least one bearing for the eccentric disk, or (iii) a fourth plane parallel to the second and third planes and located between the second and third planes, and a bent portion which circumvents the eccentric disk in a direction away from the advancing direction F of the vibration tamper and connects the first section and second section of the connecting rod, with the first section and the second section being laterally and vertically offset from each other by the bent portion.

2. A vibration tamper according to claim 1, wherein the connecting rod bearing is arranged in the eccentric disk.

3. A vibration tamper according to claim 1, wherein the bent portion of the connecting rod is arranged in such a way that the tamper axis lies in a second plane which is offset in parallel in a direction away from the advancing direction F of the vibration tamper to a first plane opened up from a section of the connecting rod on the eccentric side, with the second plane being disposed between the first plane and a third plane opened up by the bearing of the eccentric disk.

4. A vibration tamper according to claim 1, wherein the tamper axis is arranged in a plane opened up by the eccentric disk.

5. A vibration tamper according to claim 1, wherein the ratio of the masses of superstructure and substructure is balanced with respect to the tamper axis.

* * * * *